US005487206A

United States Patent [19]

Brown et al.

[11] Patent Number: 5,487,206

[45] Date of Patent: Jan. 30, 1996

[54] DOOR CONTROL DEVICE

[75] Inventors: Peter E. Brown; Stephen J. Harrison, both of Bridgnorth, England

[73] Assignee: Jerbron Limited, Wes Midlands, United Kingdom

[21] Appl. No.: 177,917

[22] Filed: Jan. 16, 1994

[30] Foreign Application Priority Data

Jan. 8, 1993 [GB] United Kingdom ..... 9300288

[51] Int. Cl.[6] ..... E05F 3/10

[52] U.S. Cl. ..... 16/52; 92/240; 92/181 R

[58] Field of Search ..... 91/422, 222; 92/181 R, 92/181 P, 182, 183, 184, 240; 16/52, 62

[56] References Cited

U.S. PATENT DOCUMENTS

| | | | |
|---|---|---|---|
| 1,299,668 | 4/1919 | Blomquist | 91/422 |
| 2,461,106 | 2/1949 | Brandt | 92/240 |
| 2,727,471 | 12/1955 | Martin | 92/182 |
| 2,774,987 | 12/1956 | Ring et al. | 16/62 |
| 2,953,810 | 9/1960 | Hall | 16/52 |
| 3,057,004 | 10/1962 | Sogoian | 16/52 |
| 3,129,453 | 4/1964 | Turner | 16/52 |
| 3,224,378 | 12/1965 | Graham | 92/182 |
| 3,284,841 | 11/1966 | Patriquin | 16/52 |
| 3,980,004 | 9/1976 | Jones et al. | 92/182 |
| 4,792,065 | 12/1988 | Soehnlein et al. | 92/181 R |
| 5,187,835 | 2/1993 | Lee | 16/52 |
| 5,193,433 | 3/1993 | Reimer | 92/240 |

FOREIGN PATENT DOCUMENTS

| | | | |
|---|---|---|---|
| 247910 | 5/1963 | Australia | 91/422 |
| 1161618 | 9/1958 | France | 92/240 |
| 1155030 | 9/1963 | Germany . | |
| 317610 | 11/1956 | Switzerland | 92/240 |
| 1260803 | 1/1972 | United Kingdom | 91/422 |
| 1313639 | 4/1973 | United Kingdom | 92/182 |
| 2158148 | 11/1985 | United Kingdom | E05F 3/10 |
| 2248905 | 4/1992 | United Kingdom | F16J 1/00 |

OTHER PUBLICATIONS

United Kingdom Search Report on Application No. GB 9300288.9 (1 page).

European Search Report on Application No. EP 93 12 0951 (1 page).

*Primary Examiner*—Thomas E. Denion

*Attorney, Agent, or Firm*—Webb Ziesenheim Bruening Logsdon Orkin & Hanson

[57] ABSTRACT

A door closing device comprises a piston (12) having at one end a seal (21) which seals the interface between the piston and a housing (10). The seal (21) also acts as a one-way valve and carries a pressure relief valve (37).

10 Claims, 2 Drawing Sheets

DOOR CONTROL DEVICE

BACKGROUND TO THE INVENTION

The present invention relates to a door control device comprising a hollow housing defining a chamber and a piston disposed in the chamber and movable relative to the housing along a rectilinear path.

It is known to incorporate in the piston of a device of the kind described a seal which engages the housing in sliding contact to seal the interface between the piston and the housing. An example of a door control device incorporating a piston is disclosed in GB 2 230 050A and an example of a piston incorporating a seal which is a snap-fit in a body of the piston is disclosed in GB 2 248 905A.

SUMMARY OF THE INVENTION

According to a first aspect of the present invention, the piston of a door control device of the kind described comprises a seal which engages the housing in sliding contact therewith to seal the interface between the piston and the housing and also seals an aperture in the piston when the piston is subjected to hydraulic pressure acting in a first direction along the path of travel of the piston.

The seal of a device embodying the first aspect of the invention performs two functions which, in the arrangements described in the aforesaid published applications were performed by two separate components.

According to a second aspect of tile invention, there is provided a door control device of the kind described wherein the piston includes a body and a seal mounted on the body, wherein a peripheral portion of the seal is in sliding contact with the housing to seal the interface between the piston and the housing, the body of the piston defines a valve seat, a further portion of the seal bears on the valve seat and wherein the further portion of the seal is flexible relative to the seat and is able to flex away from the seat when subjected to hydraulic pressure acting in one direction along the path of travel of the piston.

The further portion of the seal may define an aperture through which fluid can flow when the further portion flexes away from the seat.

According to a third aspect of the invention, there is provided a door control device of the kind described wherein the piston includes a body and a seal. Carried on the body, the seal is in sliding contact with the housing to seal the interface between the housing and the piston, the seal includes a tubular portion spaced from the housing, an elongated flow control element extends into the piston through the tubular portion of the seal, the tubular portion of the seal is in sliding contact with the flow control element and wherein the tubular portion of the seal is more flexible than is the flow control element and is thereby adapted to be driven into pressure contact with the flow control element by hydraulic pressure exerted on the outside of the tubular portion.

According to a fourth aspect of the invention, there is provided a door control device of the kind described wherein the piston includes a valve seat defining an orifice, a valve element and a resilient element arranged for urging the valve element onto the valve seat in a direction transverse to the path of movement of the piston.

More than one of said aspects of the invention are preferably used together in a single device.

BRIEF DESCRIPTION OF THE DRAWINGS

An example of a door closer embodying each aspect of the invention will now be described, with reference to the accompanying drawings, wherein.

DETAILED DESCRIPTION

Figure 1:
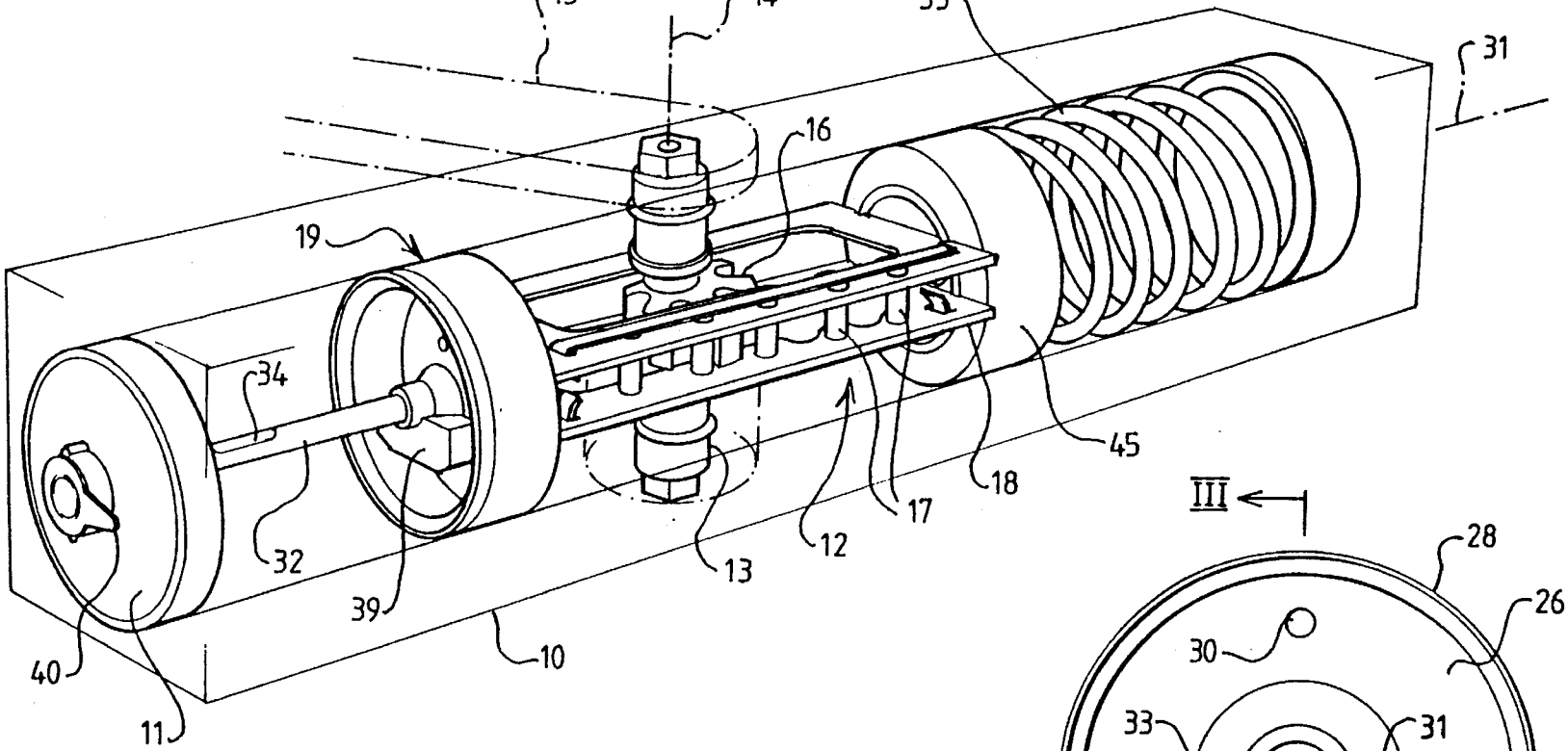
FIG. 1 shows diagrammatically a perspective view of the door closer.
Figure 2:
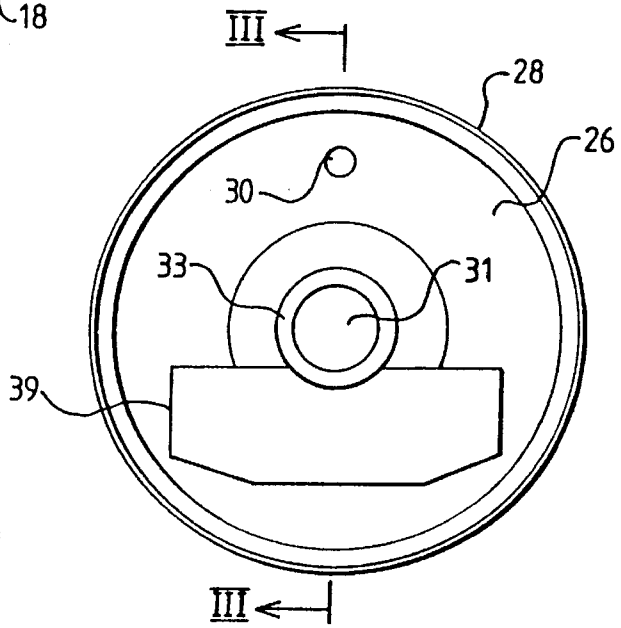
FIG. 2 shows an end view of a piston of the door closer.

The device illustrated in the accompanying drawings comprises an elongated housing 10 which may have a polygonal external profile, as viewed along the housing, for example a square profile. Means (not shown) is provided for mounting the housing on the face of a door, or on a fixed structure defining a doorway to be closed by the door. This means may include screws extending through holes in the housing into the door or other structure. The housing is hollow and may have at each of its ends respective openings which are closed by plugs. One of these plugs is identified in FIG. 1 by the reference numeral 11. The plugs may be screwed into the housing and ring seals may be associated with the plugs to prevent leakage of fluid from inside of the housing.

The device further comprises a slide 12 which is disposed inside the housing 10 for reciprocation relative thereto along a path which extends along the housing. The device also includes a control member 13 which is mounted for rotation relative to the housing about an axis 14 which is perpendicular to the length of the housing and to the path of travel of the slide 12. The control member extends across the interior of the housing and opposite portions of the control member lie in respective apertures formed in the wall of the housing. Separately formed bearing elements may be interposed between the control member and the housing in these apertures. Alternatively, the bearing supporting the control member may be constituted by the housing wall itself. Ring seals are interposed between the housing wall and the control member to prevent leakage of fluid from inside the housing. Conveniently, these seals lie in peripheral grooves formed in the control member so that the bearing surfaces of the housing can be entirely cylindrical.

At least one end portion of the control member 13 protrudes to the outside of the housing 10. On this end portion, there is fixed an arm 15 which extends radially from the axis 14. The arm is connected in a known manner with the door or the stationary structure. Typically, the arm is formed with a polygonal opening in which there is received a complementary end portion of the control member and the arm is retained on the control member by a screw (not shown) driven into the end of the control member.

The control member 13 includes an array of drive elements in the form of teeth 16. The teeth 16 are spaced from one another around the axis 14 and lie half-way along the control member. The slide 12 is provided with a row of drive elements 17 for cooperating with respective ones of the teeth 16, the length of the row extending generally along the housing 10. In the example illustrated, the drive elements 17 are formed separately from one another and are individually mounted on a common carrier 18. Alternatively, a rack having teeth formed integrally with one another may be provided in the carrier 18. The carrier is an elongated component disposed inside and arranged with its length extending along the housing.

The slide 12 further comprises a valve assembly 19 which is mounted on the carrier 18 at one end thereof. The carrier 18 connects the valve assembly with each of the drive elements 17 and connects these drive elements with one another.

The housing 10 defines a cylindrical chamber containing the slide 12 and the slide is formed to act as a piston in the chamber. The valve assembly 19 comprises a body 20 and a seal 21 mounted on the body. The seal has a peripheral portion 22 which engages the interior of the housing 10 in sliding contact therewith to seal the interface between the piston and the housing.

In the particular example illustrated in the drawings, the body 20 of the piston has the form of a cup with a cylindrical side wall 23 and a substantially flat bottom wall 24 which is perpendicular to the side wall. The outside diameter of the side wall 23 is slightly less than the internal diameter of the housing 10 to provide a small clearance between the body of the piston and the housing. The body of the piston is rigidly secured to the carrier 18, for example by welding or brazing. It will be noted that the carrier 18 lies outside the body 20.

The seal 21 lies partly inside the body 20, having a circumferential wall 25 which lies inside and adjacent to the side wall 23 of the body and a transverse portion 26 which overlaps with and lies adjacent to the bottom wall 24 of the body.

Figure 3:
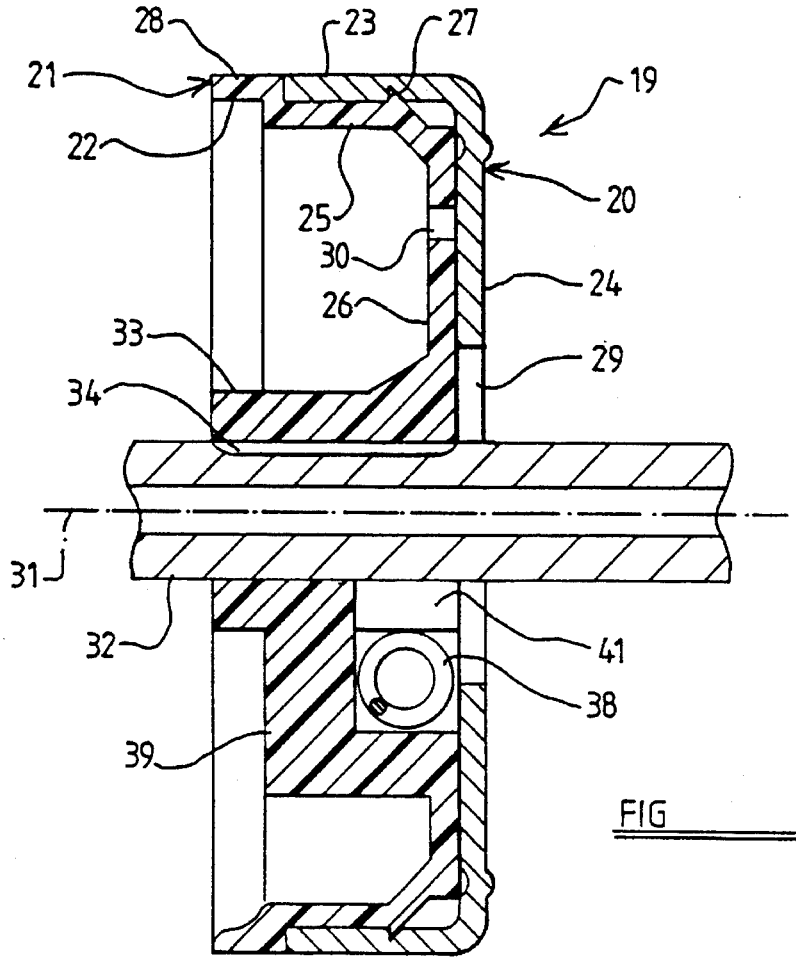
FIG. 3 shows a cross section through a part of the piston on the line III—III of FIG. 2
Figure 4:
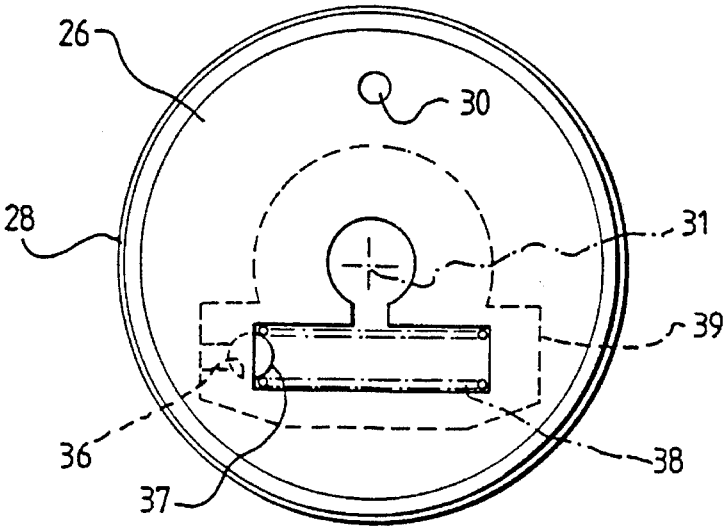
FIG. 4 shows an end view of a seal incorporated in the piston.

A circumferential groove is formed at the inside of the side wall 23 of the body 20 near to the bottom wall 24. A radially outwardly projecting rib 27 is formed on the circumferential wall 25 of the seal to seat in the groove and thereby retain the seal in assembled relation with the body 20. As shown in FIG. 3, the rib 27 is preferably tapered, being widest at a position furthest from the bottom wall 24. The rib has a flat shoulder facing away from the bottom wall 24 and this shoulder bears on a corresponding surface of the body 20 to hold the seal in the required position. The seal is resiliently deformable and this facilitates movement of the rib 27 down the wall 23 to the groove in which the rib is eventually seated.

The seal 21 also includes a lip 28 which is formed on the circumferential wall 25 but lies outside the body 20 to engage the housing 10. When unstressed, the lip 28 is slightly frusto-conical, being of larger diameter at its extremity remote from the transverse portion 26 of the seal.

A rectilinear, elongated flow control element 32 extends from the end plug 11 into the piston 12 through the seal 21 and through a central opening 29 of the piston body 20. The seal includes a tubular portion 33 which embraces a part of the flow control element 32. The tubular portion extends from the transverse portion 26 towards or to the open mouth of the seal. The tubular portion 33 is a sufficiently close sliding fit on the flow control element to prevent leakage of hydraulic fluid at the interface between this element and the seal. The arrangement of the flow control element and associated parts is described in GB 2158148A, the contents of which are incorporated herein by reference.

Along a major part of its length, the flow control element 32 is cylindrical. At one position along its length, there is formed in the element 32 at one side of the axis 31 a recess 34 having a length which exceeds the length of the cylindrical internal surface of the tubular portion 33. When the recess 34 lies inside the tubular portion 33 with opposite ends of the recess exposed beyond the cylindrical internal surface of this portion, a substantially unobstructed path is provided for flow of hydraulic fluid past the seal 21.

As hereinafter described, the element 32 can be rotated in the end plug 11 to vary the degree to which the flow path is obstructed.

The central opening 29 is formed in the bottom wall 24 of the piston body 20. Between the opening 29 and the side wall 23, the bottom wall 24 presents a flat seat for receiving the transverse portion 26 of the seal. A hole 30 is formed in this portion of the seal at a position approximately mid-way between the central opening 29 and the side wall 23. During opening of a door to which the device is fitted, the piston is driven along the axis 31 of the chamber defined by the housing in a direction away from the end plug 11. The chamber contains hydraulic fluid and the movement of the piston establishes in the fluid adjacent to the carrier 18 a pressure which is greater than that in the fluid near to the end plug 11. The pressure differential acts through the central opening 29 of the piston body on the transverse portion 26 of the seal to move this transverse portion away from its seat on the body 20 and thereby permit the fluid to flow through the central opening 29 and through the hole 30 so that movement of the piston along the housing away from the end plug 11 is not significantly impeded.

The device further comprises a spring 35 disposed inside the chamber of the housing 10. The spring acts between the housing and the piston 12 to urge the piston towards the end plug 11. One end of the spring is seated in a cup 45 attached to the carrier 18. When the piston is permitted to move along the axis 31 towards the end plug 11, there is established in the hydraulic fluid occupying the space inside the cup-shaped body 20 and seal 21 a pressure which exceeds the pressure in the hydraulic fluid immediately adjacent to the carrier 18. This pressure differential drives the transverse portion 16 of the seal onto its seat so that flow through the hole 30 is prevented. There is formed in the end plug 11 an adjustable orifice (not shown) to permit flow of hydraulic fluid at a controlled rate past the seal 21, along the interior of the flow control element 32 and into the space inside the housing 10 and near to the end plug 11. This corresponds to controlled flow in the door closer of GB 2158148A. In the event of a door to which the device is fitted being moved violently, the pressure in the hydraulic fluid occupying the interior of the seal may increase beyond that pressure which is established by the spring 35 during normal operation. To avoid the establishment of an excessive pressure, a relief valve is provided in the seal 21.

The seal defines a valve seat 36 leading to an orifice which is normally closed by a relief valve element 37 urged onto the seat 36 by a coiled compression spring 38. The spring 38 is mounted in the seal 21 and is arranged with its longitudinal axis transverse to the axis 31 of the chamber. The seal 21 incorporates a housing 39 for the spring 38 and the valve element 37. This housing is open at one side, namely that side which faces towards the bottom wall 24 of the piston body 20 so that the wall 24 prevents the spring and the valve element escaping from the housing 39.

The space defined inside the housing 39 intersects and communicates with the space defined inside the tubular portion 33 of the seal. Accordingly, the internal surface of the tubular portion 33 is cylindrical only along that part of the tubular portion which is spaced from the internal space of the housing 39. Adjacent to the internal space of the housing 39, the internal surface of the tubular portion 33 defines only a part of a cylinder, subtending at its axis an angle within the range 270° to 300°. The complement of this angle represents a port 41 leading from the interior of the tubular portion 33 to the interior of the housing 39 and to the central opening 29 of the piston body 20.

At the outside of the end plug 11, there is provided a handle 40 which is rigidly connected with the flow control element 32. This element is mounted in the end plug 11 for turning relative thereto about the axis 31. The flow control element can be turned between a position in which the recess 34 is entirely aligned with the port 41, to a position in which the recess is entirely offset circumferentially from the port 41. Intermediate positions provide varying degrees of obstruction of flow through the recess 34, when the latter lies inside the tubular portion 33. The flow control element can be set so that, as a door to which the device is fitted approaches a closed position, flow of hydraulic fluid past the seal 21 takes place more easily and the piston 12 accelerates towards the end plug 11, thereby permitting the door to accelerate and overcome resistance to closing resulting, for example, from the action of a latch.

The circumferential wall 25, transverse portion 26, rib 27, lip 28, tubular portion 33 and housing 39 of the seal 21 are formed integrally with one another as a one-piece moulding. The seal is resiliently flexible and is formed of a plastics material which has good resistance to wear. There is selected for manufacture of the seal 21 a material which has limited flexibility. The tubular portion 33 is capable of flexing onto the control element 32 under pressure along the majority of its length to be an effective seal but the portion 33 does not collapse into the recess 34 when the part of the control member comprising that recess lies within the seal. A polyurethane is a suitable material for the seal. The body 20 and the carrier 18 of the piston 12 are rigid, relative to the seal 21, and are conveniently formed of steel or other metal. The relief valve element 37 and associated spring 38 also may be formed of steel.

It will be understood that the seal 21 can be formed and can be assembled with other components of the device relatively inexpensively.

The flexibility of the tubular portion 33 is such that, when the pressure in the hydraulic fluid occupying the space inside the seal is raised, the tubular portion is contracted onto the flow control element 32 to seal the interface between that element and the seal 21. Any small departure from a coaxial relation between the chamber of the body 10 and the flow control element 32 is accommodated by flexing of the seal.

We claim:

1. A door control device comprising a hollow housing defining a chamber and a piston disposed in the chamber and capable of reciprocal movement relative to the housing along a rectilinear path, the door control device further comprising an elongate flow control element which extends into the piston, the piston having a face which is transverse to said path, said face having an aperture spaced from the housing, the piston comprising a seal with a radially outer portion which engages the housing in sliding contact therewith to seal the interface between the piston and the housing and a radially inner portion which slidably engages the elongated flow control element and wherein the seal also includes a relatively flexible intermediate portion overlapping said face of the piston, which intermediate portion seals the aperture in the piston when the piston is subjected to hydraulic pressure acting in a first direction along the path of travel of the piston and wherein the face of the piston provides a seat for said flexible portion of the seal and said flexible portion can flex away from the seat when subjected to hydraulic pressure acting in a second direction along said path.

2. A device according to claim 1 wherein the body of the piston defines said aperture in the piston and said flexible portion of the seal defines an aperture which is offset from the aperture in the body.

3. A device according to claim 1 wherein the flexible portion of the seal is a substantially flat web.

4. A device according to claim 1 wherein the seal is a snap-fit on the body.

5. A device according to claim 1 wherein each of the seal and the body has the form of a cup and wherein the seat is at a bottom of the cup which forms the body.

6. A device according to claim 1 wherein the radially inner portion of the seal has a tubular portion which embraces the flow control element and wherein the tubular portion is resiliently flexible relative to the flow control element.

7. A device according to claim 6 wherein the tubular portion has an internal surface which is cylindrical along a part of the length of the tubular portion and which is part cylindrical along a further part of the length of the tubular portion.

8. A device according to claim 1 wherein the elongated flow control element extends into the piston through the seal, wherein the radially inner portion of the seal includes a tubular portion embracing the flow control element, the tubular portion being resiliently flexible relative to the flow control element and wherein the tubular portion is connected with a circumferential portion of the radially outer portion of the seal only by said relatively flexible intermediate portion overlapping said face.

9. A device according to claim 1 wherein the seal carries a pressure relief valve.

10. A device according to claim 9 wherein the pressure relief valve comprises a valve element and a spring urging the valve element in a direction transverse to the path of movement of the piston, the seal defines a seat for the valve element and the spring urges the valve element onto the seat defined by the seal.

* * * * *

UNITED STATES PATENT AND TRADEMARK OFFICE

CERTIFICATE OF CORRECTION

PATENT NO. : 5,487,206

DATED : January 30, 1996

INVENTOR(S) : Peter E. Brown and Stephen J. Harrison

It is certified that error appears in the above-indentified patent and that said Letters Patent is hereby corrected as shown below:

Title page, section '[73] Assignee:', "Jerbron Limited, Wes Midlands," should read --Jebron Limited, West Midlands,--.

Title page, section '[22] Filed:', "Jan. 16, 1994" should read --Jan. 6, 1994--.

Column 1 Line 31 "tile" should read --the--.

Column 4 Line 36 "portion 16" should read --portion 26--.

Signed and Sealed this

Twenty-third Day of April, 1996

Bruce Lehman

*Attest:*

BRUCE LEHMAN

*Attesting Officer*

*Commissioner of Patents and Trademarks*